US012637258B2

(12) United States Patent
Mertzel

(10) Patent No.: US 12,637,258 B2
(45) Date of Patent: May 26, 2026

(54) SIMPLIFIED SQUEEZE BOTTLE CAP WITH GASKET COMPONENT HAVING A TOP WALL

(71) Applicant: Joelle Mertzel, Porter Ranch, CA (US)

(72) Inventor: Joelle Mertzel, Porter Ranch, CA (US)

(73) Assignee: Kitchen Concepts Unlimited LLC, Northridge, CA (US)

( * ) Notice: Subject to any disclaimer, the term of this patent is extended or adjusted under 35 U.S.C. 154(b) by 214 days.

(21) Appl. No.: 18/233,310

(22) Filed: Aug. 12, 2023

(65) Prior Publication Data

US 2025/0011048 A1 Jan. 9, 2025

Related U.S. Application Data

(63) Continuation-in-part of application No. 18/219,690, filed on Jul. 9, 2023, now Pat. No. 12,358,680.

(51) Int. Cl.
*B65D 41/04* (2006.01)
*B65D 47/06* (2006.01)

(52) U.S. Cl.
CPC ..... *B65D 41/0457* (2013.01); *B65D 47/065* (2013.01); *B65D 2251/205* (2013.01)

(58) Field of Classification Search
CPC .. B65D 47/305; B65D 47/061; B65D 47/065; B65D 41/0457; B65D 2251/205
See application file for complete search history.

(56) References Cited

U.S. PATENT DOCUMENTS 1,051,688 A * 1/1913 Cole ..... B65D 47/305 222/536
1,250,081 A * 12/1917 Bennis ..... B65D 47/061 251/91
2,701,668 A * 2/1955 Zayan ..... B65D 47/305 222/536
2,727,658 A * 12/1955 Mart ..... B65D 47/305 222/536
3,163,337 A * 12/1964 Wilson ..... B65D 47/305 222/536
RE26,318 E * 12/1967 Wilson ..... B65D 47/305 222/536
3,568,895 A * 3/1971 Porter ..... B65D 47/305 222/536
3,751,787 A * 8/1973 Porter ..... B65D 47/305 222/536
4,674,661 A * 6/1987 Herold ..... B05C 17/00593 222/533

* cited by examiner

*Primary Examiner* — Paul R Durand
*Assistant Examiner* — Randall A Gruby
(74) *Attorney, Agent, or Firm* — Andrus Intellectual Property Law, LLP

(57) ABSTRACT

A cap for a squeeze bottle that is simply constructed, easily manufactured, simple to assemble and easily reassembled. The cap includes three components, a rounded lid with a slot, a nozzle with a near spherical base and an extended cone portion, and a gasket with a top, bottom and side walls to form a pocket. The user may insert and remove the nozzle from the pocket by pushing and pulling, respectively, on the stem.

19 Claims, 21 Drawing Sheets

SIMPLIFIED SQUEEZE BOTTLE CAP WITH GASKET COMPONENT HAVING A TOP WALL

PRIORITY CROSS-REFERENCE TO RELATED APPLICATION

This application is a continuation-in-part and claims priority pursuant to 35 U.S.C. 120 from U.S. patent application Ser. No. 18/219,690 entitled SIMPLIFIED CAP FOR SQUEEZE BOTTLE, filed on Jul. 9, 2023, which Application is expressly incorporated herein by reference.

FIELD OF THE INVENTION

The present invention relates generally to caps for squeeze bottles and more particularly to a simple three-part cap that is robust and simply constructed.

BACKGROUND OF THE INVENTION

Various squeeze bottle apparatus are known in the prior art. Generally, squeeze bottles are defined in Wikipedia as "a type of container such as a plastic bottle for dispensing a fluid, that is powered by squeezing the container with the user's hand. Its fundamental characteristic is that manual pressure applied to a resilient hollow body is harnessed to compress fluid within it and thereby expel the fluid through some form of nozzle." Examples include common plastic condiment bottles for ketchup and mustard. These typically are formed with a cylindrical squeeze bottle and a threaded cap with a fixed tapered nozzle. Some caps have open nozzles while others have small covers. Other examples are found in beauty shops and pet grooming establishments and are used for soaps and dyes.

All of the examples tend to be messy and somewhat difficult to use. For better control, some squeeze bottles have rotating nozzles that close the bottle when the nozzle stem is perpendicular to the longitudinal axis of the bottle and open the bottle when the nozzle stem is pointed upward or generally parallel to the longitudinal axis of the bottle. However, these caps are structurally complicated, as shown here in FIGS. 22-25, of the accompanying drawings, they are difficult to make and assemble by the manufacturer, they are difficult to reassemble by the consumer when disassembled for washing, and they tend to leak.

The inventive apparatus disclosed and claimed here should alleviate these problems.

SUMMARY OF THE INVENTION

The inventive cap apparatus is simply constructed and includes component is generally perpendicular to a longitudinal axis of the bottle and an open position where the bottle is open and the conical stem of the nozzle component is generally parallel to the longitudinal axis of the bottle.

The invention includes a cap apparatus for a squeeze bottle, the cap having three components, a lid component having a rounded shape, an open bottom, a threaded inner portion for engaging a threaded outer portion of a bottle, the threaded inner portion of the lid having a first diameter, the lid component also having an integral lower flange located above the threaded inner portion, an integral sidewall having multiple grooves extending away from the lower flange above the threaded inner portion, an integral curved nozzle seat located above the grooves and the upper flange, and a curved nozzle slot, a nozzle component having a generally spherical base with a central opening and an integral extended conical stem with a central opening, a centerline of the central openings of the base and the conical stem defining a longitudinal axis of the nozzle component, the spherical base for being received by the nozzle seat of the lid component, and the conical stem for rotating within the curved nozzle slot of the lid component, and a gasket component having a lower circular flange, a bottom wall, a side wall, and an integral top wall with a curved slot for the conical stem of the nozzle component, the bottom wall, the side wall and the top wall forming a pocket for removably receiving the spherical base of the nozzle component, the bottom wall having an opening for selective alignment with the central openings of the spherical base and the conical stem of the nozzle component, the selective alignment being a function of the position of the nozzle component in the pocket and along the curved nozzle slots of the lid and gasket components.

The invention also relates to a method for assembling a cap apparatus for a squeeze bottle including the steps of providing a rounded lid component having an open bottom, and a threaded inner portion for engaging a threaded outer portion of a squeeze bottle, providing a nozzle component having a generally spherical base with a central opening and an extended stem with a central opening, providing a gasket component having a lower circular flange, a bottom wall, a side wall, and an integral top wall with a curved slot for the conical stem of the nozzle component, the bottom wall, the side wall and the top wall forming a pocket for removably receiving the spherical base of the nozzle component, the bottom wall having an opening for selective alignment with the central openings of the spherical base and the stem of the nozzle component, the selective alignment being a function of the position of the nozzle component in the pocket and along the curved nozzle slots of the lid and gasket components, locating the spherical base of the nozzle component in the pocket of the gasket component, and locating the stem of the nozzle component within the curved nozzle slot of the lid component.

BRIEF DESCRIPTION OF THE DRAWINGS

For the purpose of facilitating an understanding of the invention, the accompanying drawings and detailed description illustrate a preferred embodiment thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
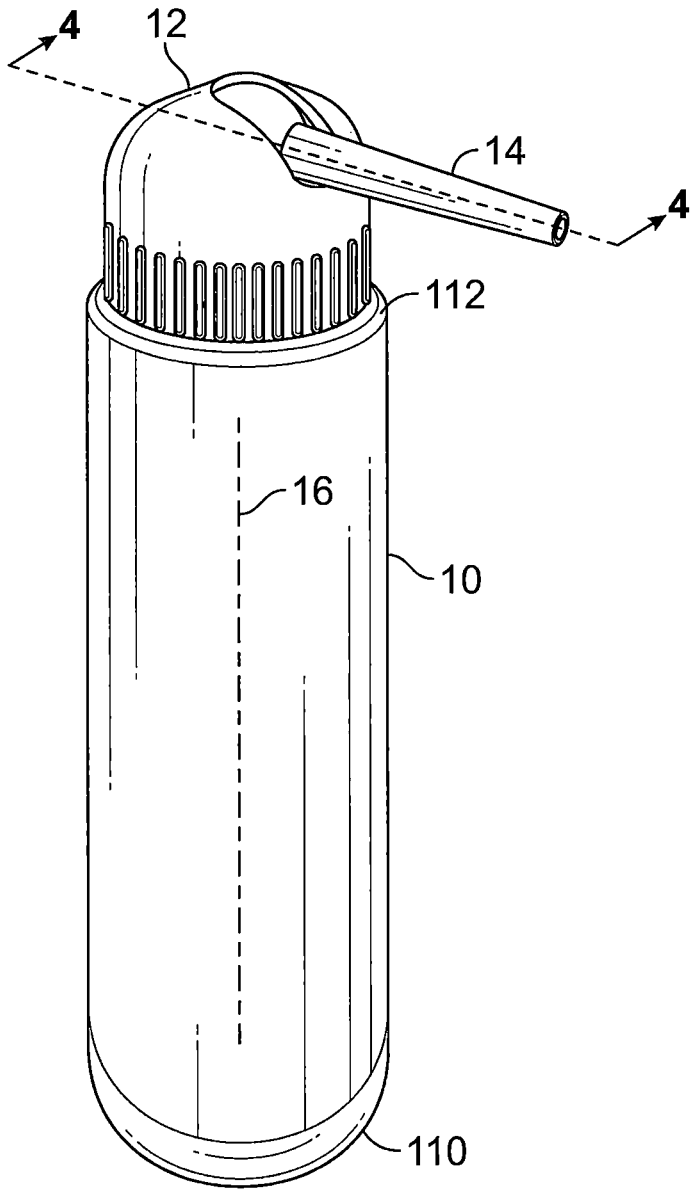
FIG. 1 is an isometric view of the inventive cap apparatus attached to a squeeze bottle where the cap is in a closed position.
Figure 2:
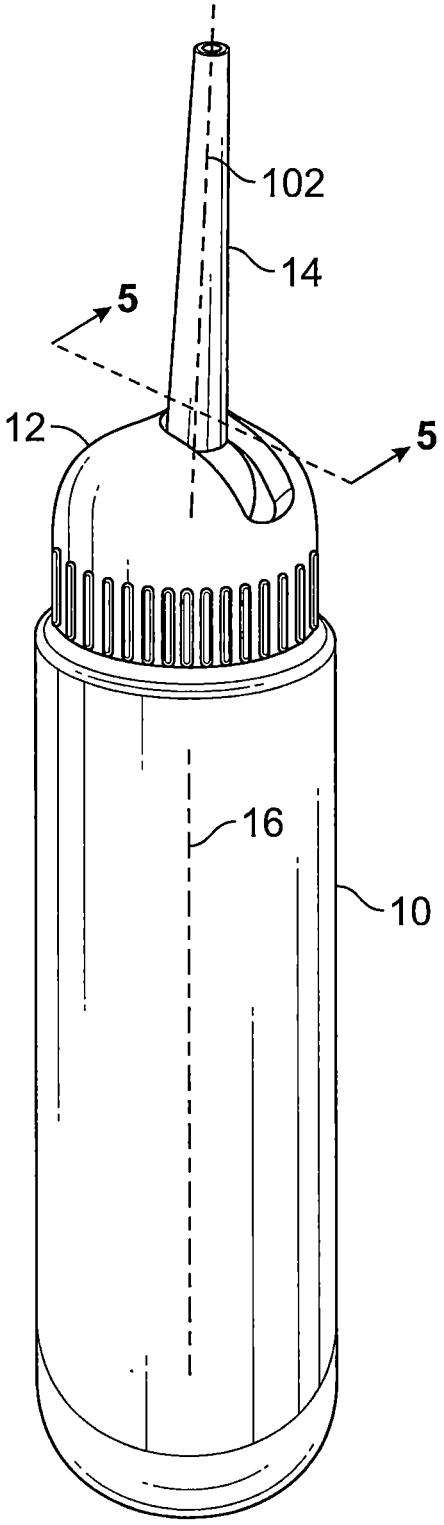
FIG. 2 is an isometric view of cap and squeeze bottle shown in FIG. 1, where the cap is in an open position.

Referring to FIGS. 1 and 2, there is shown a squeeze bottle 10 with the inventive cap 12, the cap having a rotatable nozzle component 14, that closes the bottle 10 when the nozzle component extends generally perpendicular to a longitudinal axis 16 of the bottle 10 (see FIG. 1), and when the nozzle component 14 extends generally parallel to the longitudinal axis 16 (see FIG. 2), the bottle opens.

Figure 3:
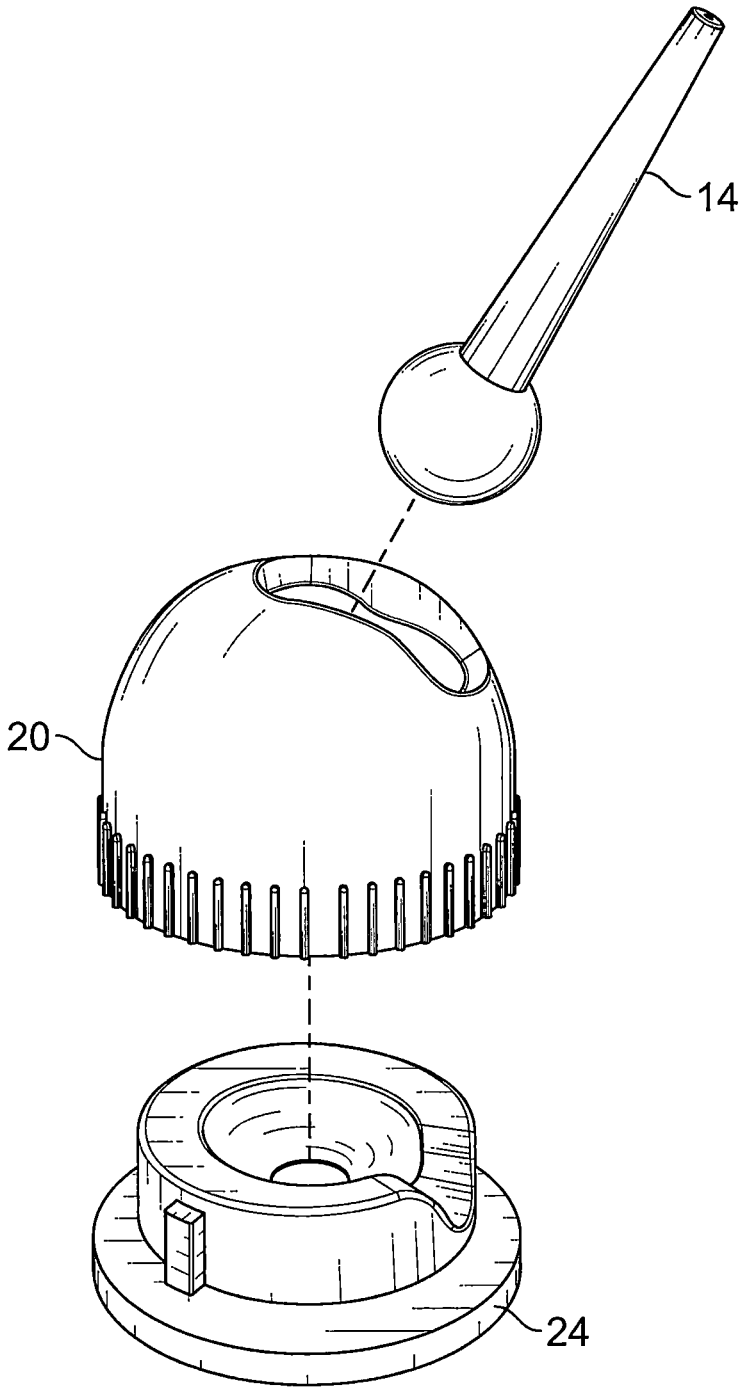
FIG. 3 is an enlarged exploded isometric view of the cap shown in FIGS. 1 and 2.
Figure 4:
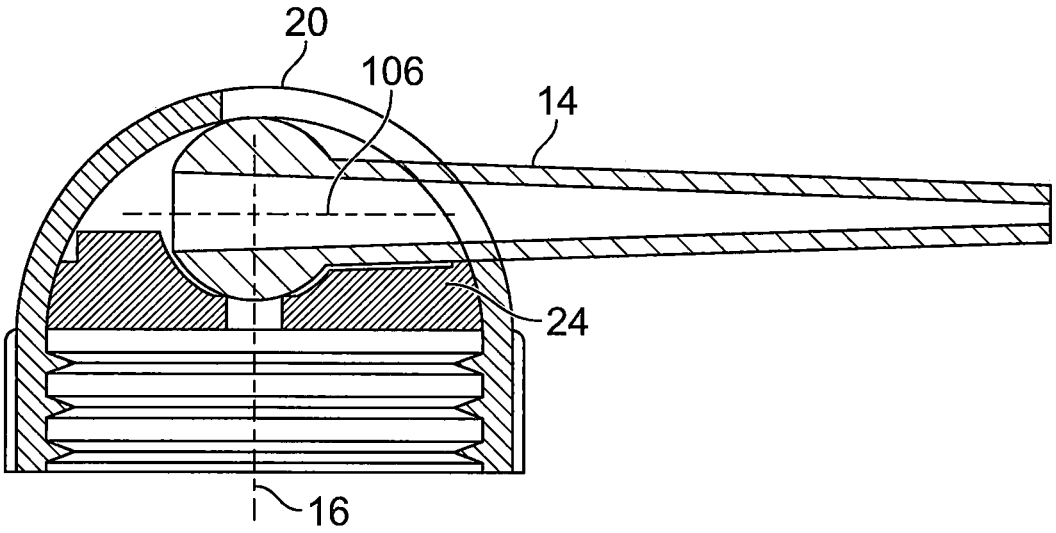
FIG. 4 is an enlarged cross-sectional view of the cap taken along line 4-4 in FIG. 1.

The inventive cap 12 includes three simply constructed components shown in exploded view in FIG. 3, a lid component 20 (also shown in FIGS. 6-11), the nozzle component 14 (also shown in FIGS. 13-16, and a gasket component 24 (also shown in FIGS. 17-21). In FIG. 4, the cap 12 is shown in a closed position in a cross-sectional view, and in FIG. 5, the cap 12 is shown in an open position in a similar cross-sectional view.

Figure 5:
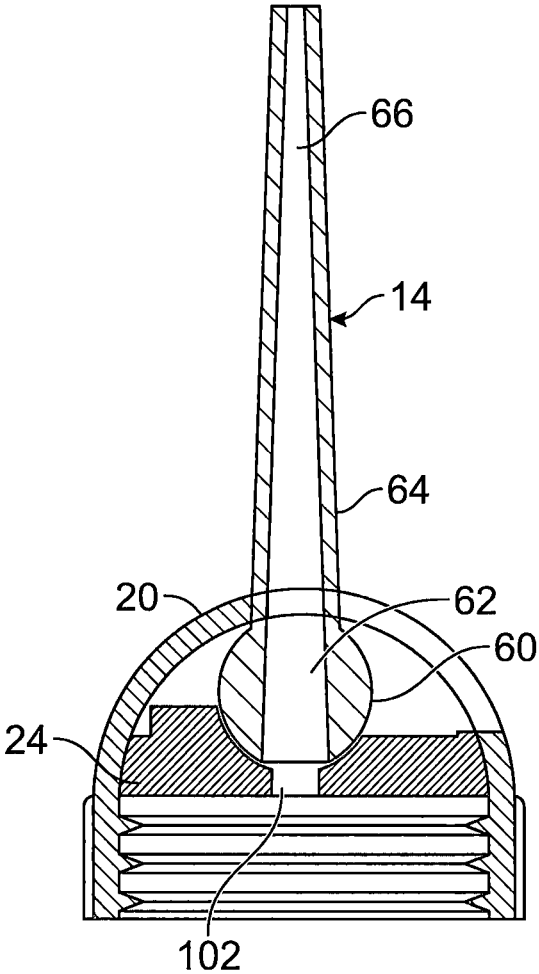
FIG. 5 is an enlarged cross-sectional view of the cap taken along line 5-5 of FIG. 2.
Figure 6:
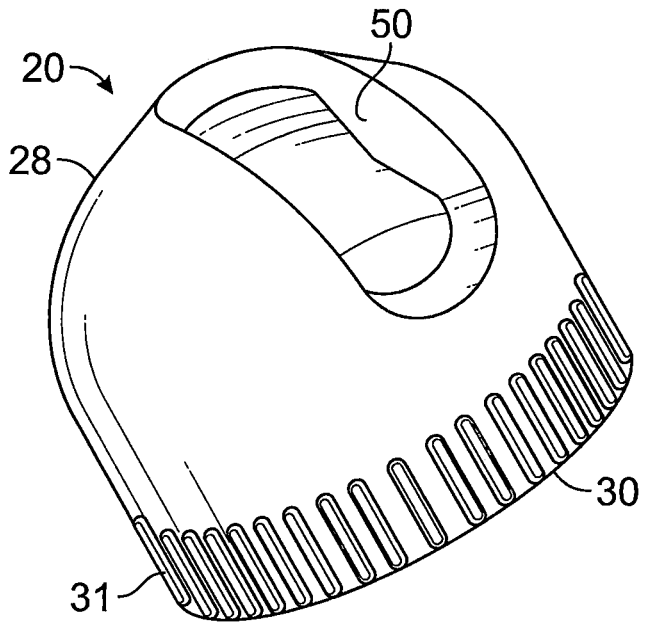
FIG. 6 is an enlarged isometric view of a lid component of the cap shown in FIGS. 1-3.
Figure 7:
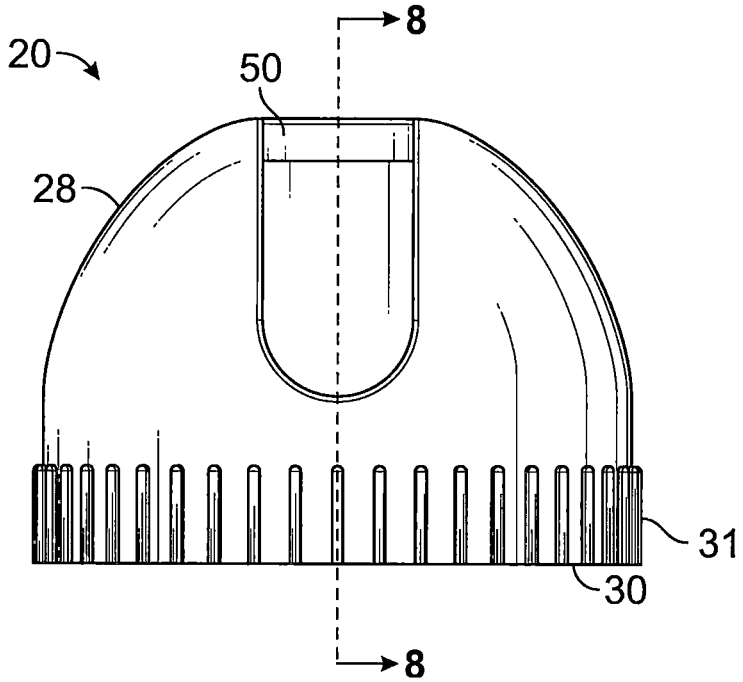
FIG. 7 is a front elevation view of the lid component shown in FIG. 6.
Figure 8:
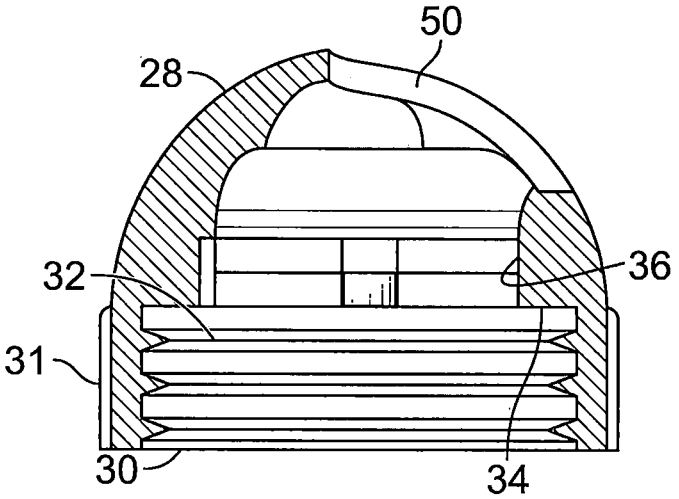
FIG. 8 is a cross-sectional view along line 8-8 in FIG. 7.
Figure 9:
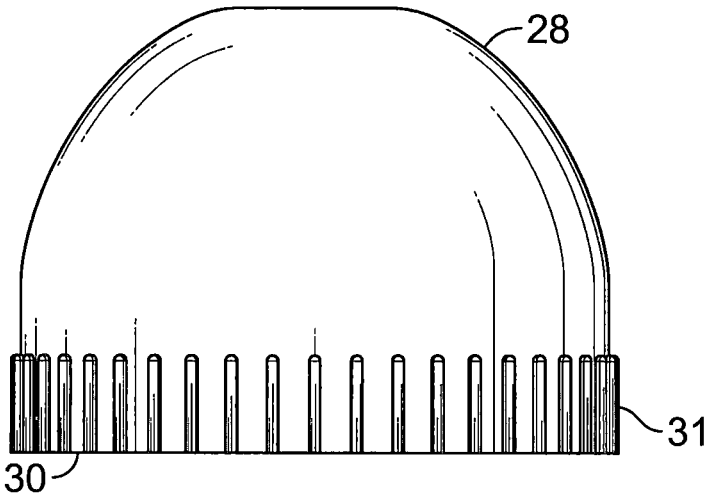
FIG. 9 is a rear elevation view of the lid component shown in FIGS. 6-8.

The lid component 20, FIGS. 6-11, includes a somewhat rounded shaped upper portion 28 and an open bottom portion 30, a threaded inner portion 32 around the open bottom 30, an outer grip portion 31, the threaded inner portion 32 for engaging a threaded outer portion (not shown) at the top of the bottle 10. Above the threaded inner portion 32 is a lower flange 34 and a sidewall 36 having multiple grooves 40, 42, 44, the grooves extending away from the lower flange 34. Above the grooves 40, 42, 44 are an upper flange 46 and a curved nozzle seat 48. A curved nozzle slot 50 extends long enough from the top of the upper portion 28 to about half way down the upper portion to allow the nozzle component 14 to move through about ninety degrees thereby allowing the nozzle to rotate between the open position as shown in FIGS. 2 and 5, and the closed position as shown in FIGS. 1 and 4.

The structure of the lid component 20 is simply constructed, easy to take apart from the bottle and other components, easy to clean and easy to reassemble. The inner diameter of the lid may be about 31 mm. The outer diameter of the bottle 10 may also be about 31 mm. In the alternative, bottles and caps of other corresponding dimensions may be used.

The nozzle component 14, FIGS. 12-15, includes a generally spherical base portion 60 with a central opening 62 and an extended cone portion 64, also with a central opening 66. The central opening 62 of the spherical base portion 60 aligns with the central opening 66 of the cone portion 64 to form one continuous opening. It is the cone portion that is able to rotate in the nozzle slot 50 of the lid component. As will be explained below, the central openings 62, 66 of the spherical base 60 and the cone portion 64, respectively, enable flowable contents in the bottle 10 to exit when the nozzle component is in the open position. The spherical base 60 is partially located in the curved nozzle seat 48 of the lid component 20. Unlike prior squeeze bottle caps, the spherical base portion 60 of the nozzle component is simply constructed and does not require opposing shafts to enable rotation. Hence, when the cap is disassembled for cleaning, for example, it may be reassembled with ease. Also, the nozzle structure is simply constructed and is easy to manufacture.

The gasket component 24, FIGS. 16-21, includes a lower circular flange portion 70 at a first level 72 with an outer diameter to fit snugly with the inner threaded portion 32 of the lid component 20 to seal the cap 12 and the bottle 10 and prevent leaks. A circular platform 74 is integral with the lower flange 70, the platform having a sidewall 76 with multiple ribs 78, 80, 82, each rib for being received by a corresponding groove 40, 42, 44 in the lid component 20. The platform includes a top wall 90 at a second level surrounding a partial spherical seat 94 to accommodate the spherical base portion 60 of the nozzle component 14. The top wall 90 is circular and extends around the gasket component to a curved recess 96 at a third level for seating the cone portion 64 of the nozzle component 14. Beneath the flange portion 70 is a lower circular or skirt wall 100.

The nozzle seat 94 in the gasket component 24 includes a central opening 102 in a bottom wall 104 that is raised or at a higher level than the bottom of the skirt wall 100, the central opening 102 being selectively aligned with the central openings 62, 66 of the nozzle base portion 60 and of the nozzle cone portion 64, respectively. When the bottle 10 is open, the central opening 102 in the of the nozzle seat 94, the central opening 62 in the spherical base 60, and the central opening 66 in the cone portion 64 are aligned with the longitudinal axis 106, FIG. 13, of the nozzle component (see FIG. 5), and these are parallel to the longitudinal axis 16 of the bottle 10, FIG. 2. In the open position, the flowable contents in the bottle may easily exit.

Figure 13:
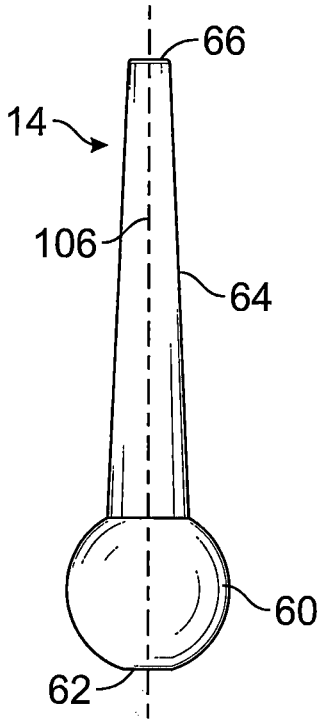
FIG. 13 is an elevation view of the nozzle component shown in FIG. 12.
Figure 14:
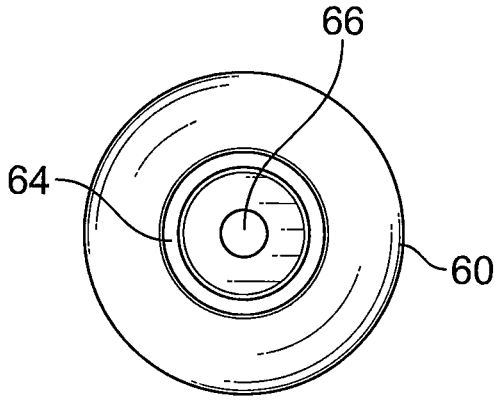
FIG. 14 is an enlarged top plan view of the nozzle component shown in FIGS. 12 and 13.
Figure 15:
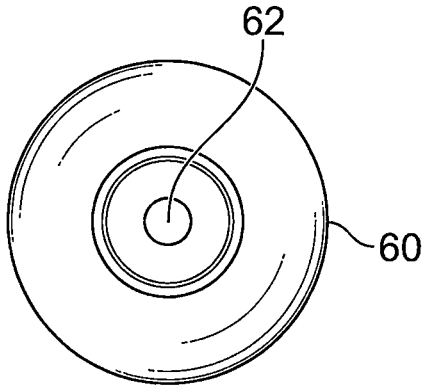
FIG. 15 is a bottom plan view of the nozzle component shown in FIGS. 12-14.
Figure 16:
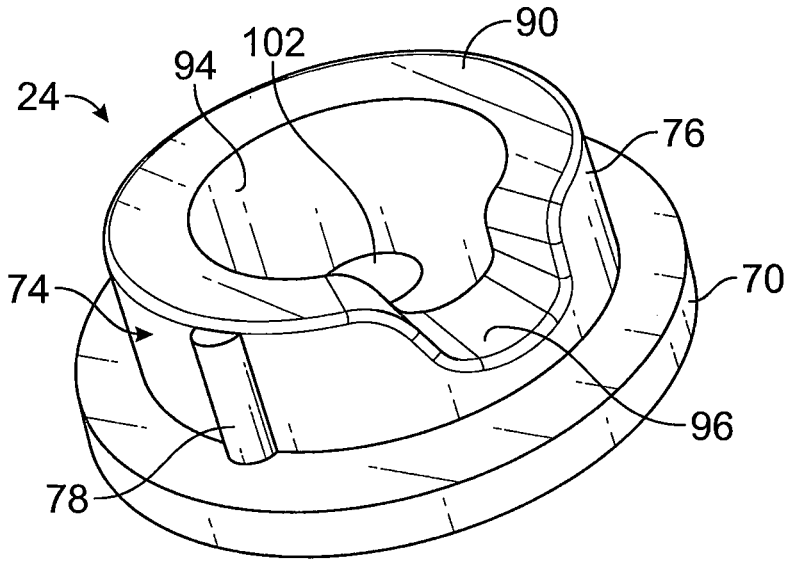
FIG. 16 is an enlarged isometric view of a gasket component of the cap apparatus shown in FIGS. 1-3.
Figure 17:
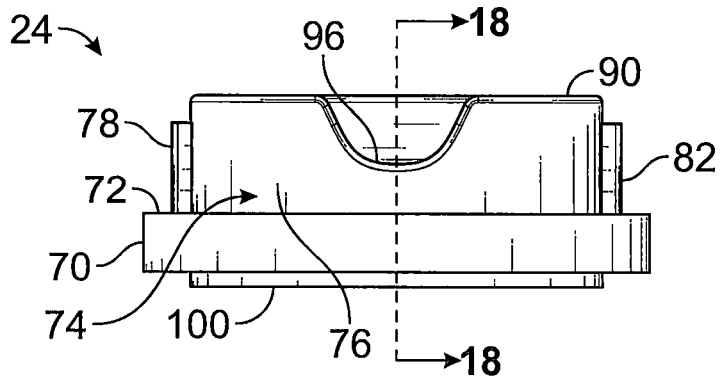
FIG. 17 is a front elevation view of the gasket component shown in FIG. 16.
Figure 18:
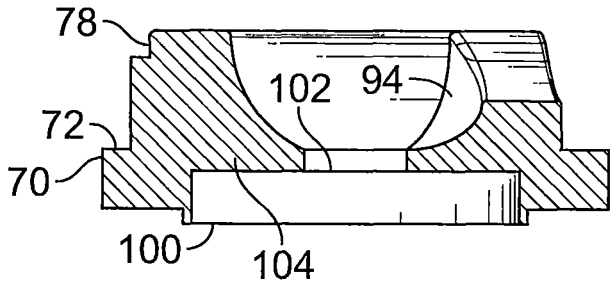
FIG. 18 is a cross-sectional view taken along line 18-18 in FIG. 17.
Figure 19:
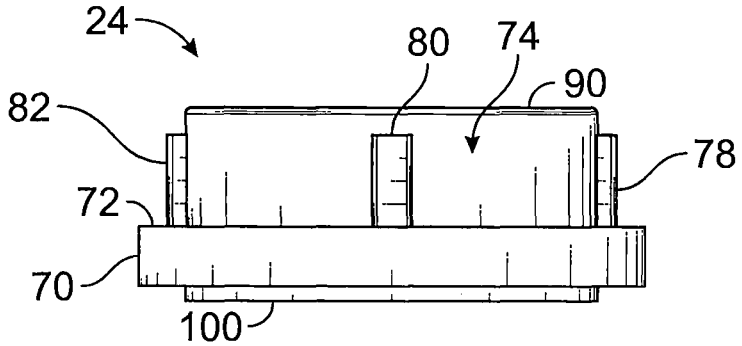
FIG. 19 is a rear elevation view of the gasket component shown in FIGS. 16-18.
Figure 20:
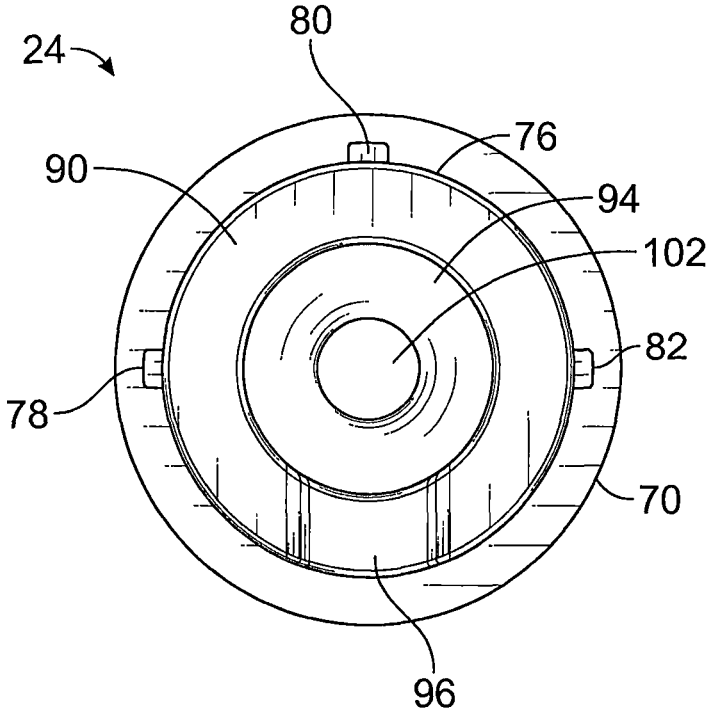
FIG. 20 is a top plan view of the gasket component shown in FIGS. 16-19.
Figure 21:
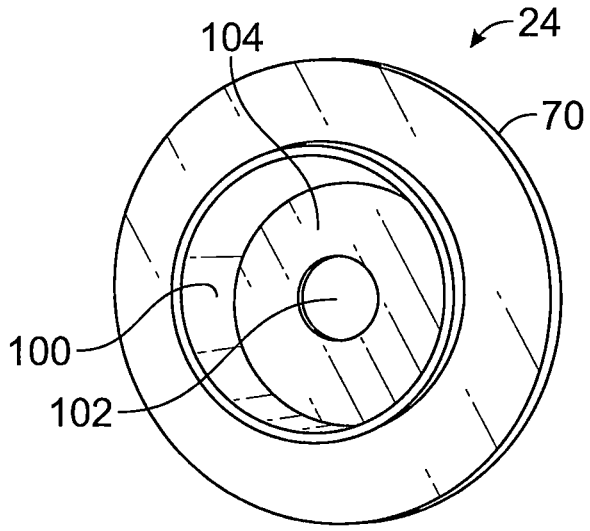
FIG. 21 is an isometric bottom view of the gasket component shown in FIGS. 16-20.
Figure 22:
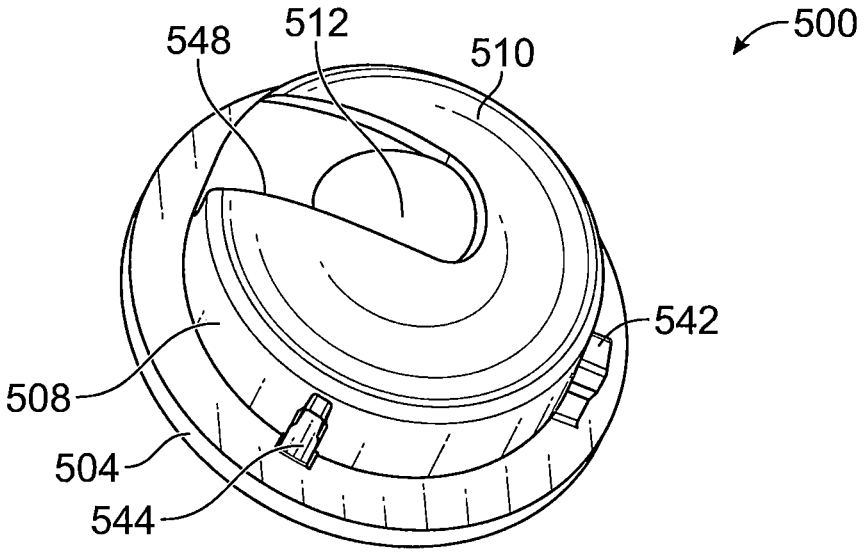
FIG. 22 is a downward looking isometric view of another gasket component embodiment, the gasket component having a top wall.
Figure 23:
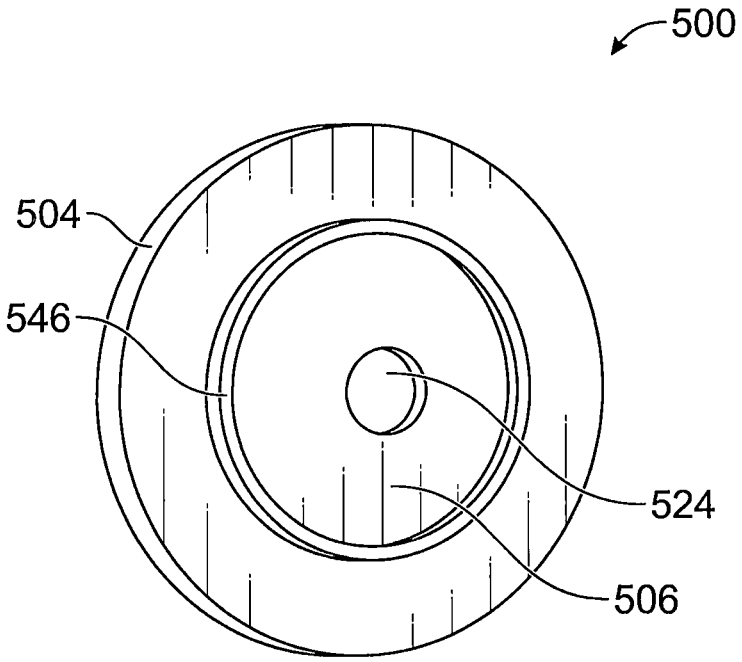
FIG. 23 is an upward looking isometric view of the gasket component shown in FIG. 22.
Figure 24:
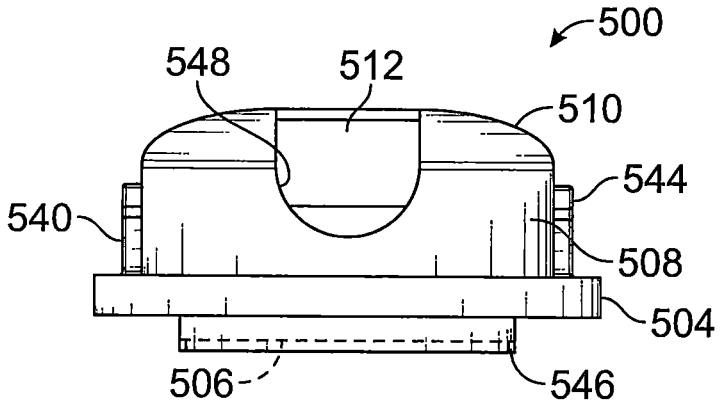
FIG. 24 is a front elevation view of the gasket component shown in FIGS. 22 and 23.
Figure 25:
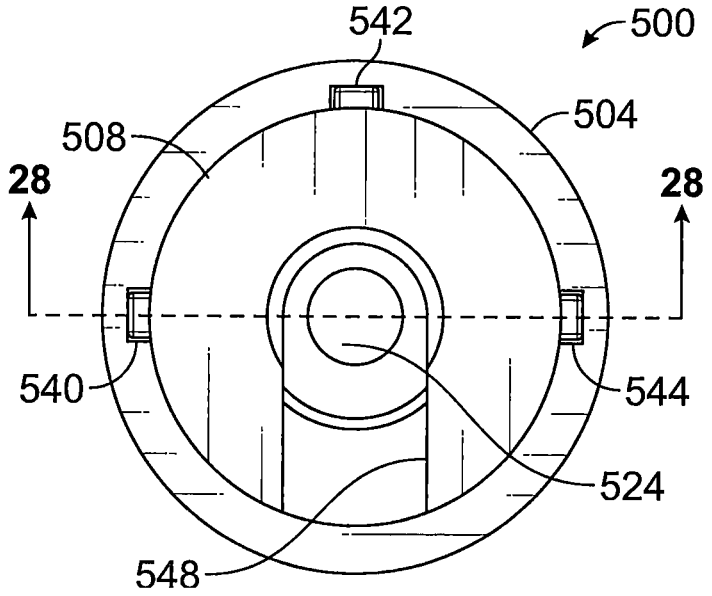
FIG. 25 is a top plan view of the gasket component shown in FIGS. 22-24.
Figure 26:
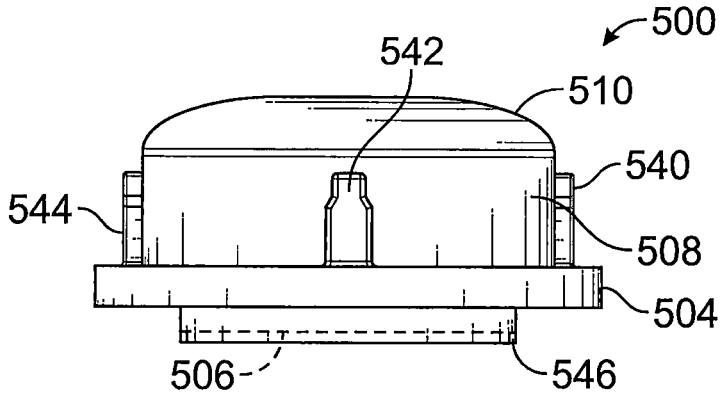
FIG. 26 is a rear elevation view of the gasket component shown in FIGS. 22-25.
Figure 27:
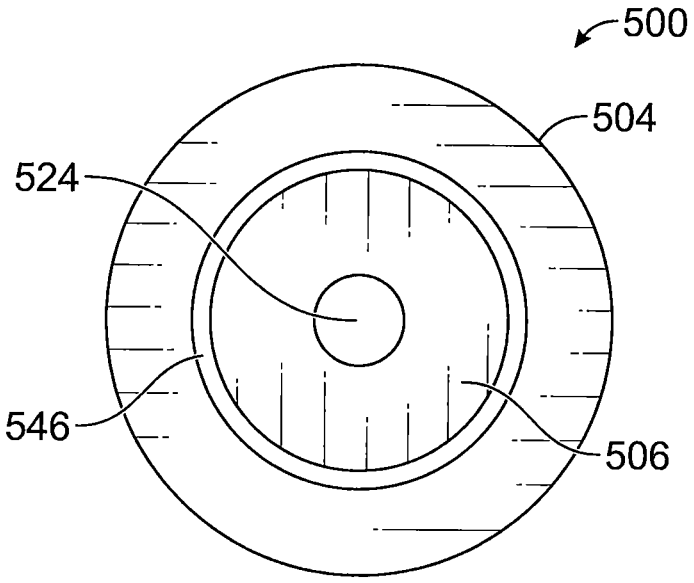
FIG. 27 is a bottom plan view of the gasket component shown in FIGS. 22-26.
Figure 28:
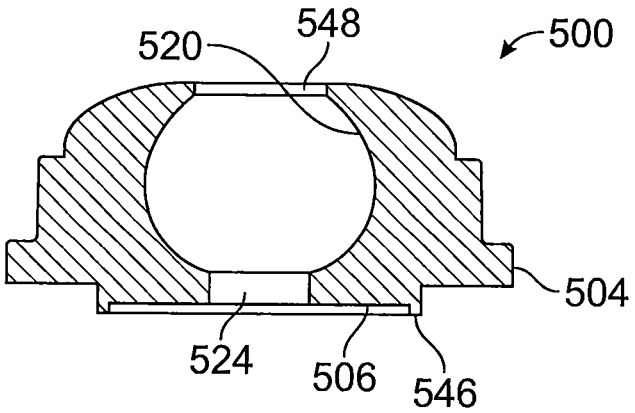
FIG. 28 is a cross-section view taken alone line 28-28 of FIG. 25.

By simply rotating the cone portion 64 of the nozzle through about ninety degrees, the central opening 62 of the spherical base 60 of the nozzle 12 is misaligned with the central opening 102 in the gasket component 24 so as to close off the contends in the bottle 10 as shown in FIGS. 1 and 4, where the longitudinal axis 106, FIG. 13, of the cone portion 64 is misaligned with the longitudinal axis 16 of the bottle, the longitudinal axis 106 of the of the cone portion of the nozzle component being generally perpendicular to the longitudinal axis 16 of the bottle. Rotation of the cone portion 64 of the nozzle may be accomplished with any portion of a user's hand, or the user may press the cone portion 64 of the nozzle component against another object to cause the nozzle component to rotate between the positions shown in FIGS. 1 and 2.

The dimension of the inner diameter of the threaded inner portion 32 of the lid component 20 is about 31 mm for a bottle having an outer threaded top of about 33 mm. The height of the bottle may be about 198 mm and may be tapered from a bottom 110 of about 64 mm to an outer diameter of about 40 mm just below the threaded portion 112. The lid and nozzle components may be formed of polypropylene and be somewhat rigid, while the gasket component may be formed of silicone and be flexible.

The flange portion 70 of the gasket component 24 may have a diameter of about 30.6 mm, and a thickness of about 2.5 mm. The height of the gasket component may be about 10.9 mm and the height of the platform may be about 6.6 mm. The diameter of the platform may be about 23.8 mm and the diameter of the skirt wall may be about 19.6 mm. The central opening 102 may have a diameter of about 6 mm and the recess 96 may have a radius of about 4.1 mm and a width of about 8.11 mm. The nozzle seat 94 may have a diameter of about 13.91 mm.

Like the lid and nozzle components, the gasket component is simply constructed resulting in the cap being easily reassembled after being disassembled for cleaning, for example. The three components are cheaper to manufacture and assemble, less likely to leak, will last longer and have better temperature, pressure and corrosion resistance than the prior art caps.

Several more advantages are achieved than those already mentioned above. With the simplified structure, washing and filing the bottle is simple. When the cap is twisted off the bottle, the three components do not fall apart. And because of their simple construction, the components are easily reassembled. The cone portion of the nozzle component 14 is merely inserted into the slot 50 of the lid component 20 and the gasket component 24 is aligned with the spherical base 60 and the cone portion 64 of the nozzle component. Thereafter, the gasket component is pressed into place in the lid component.

Figure 31:
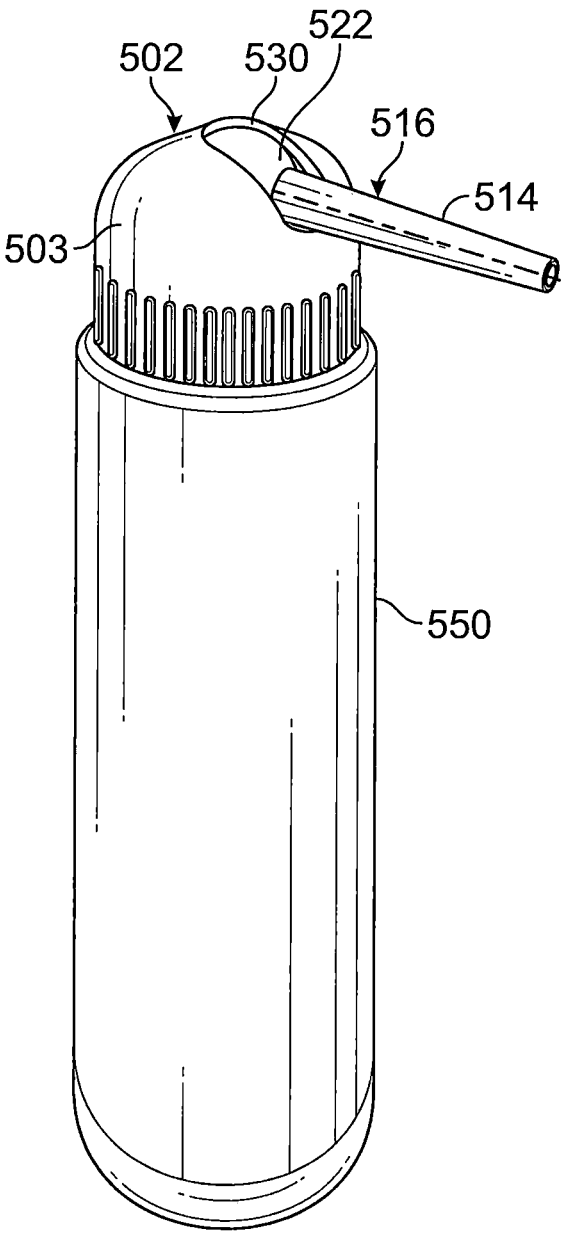
FIG. 31 is an isometric view of an inventive cap apparatus attached to a squeeze bottle where the cap is in a closed position.
Figure 32:
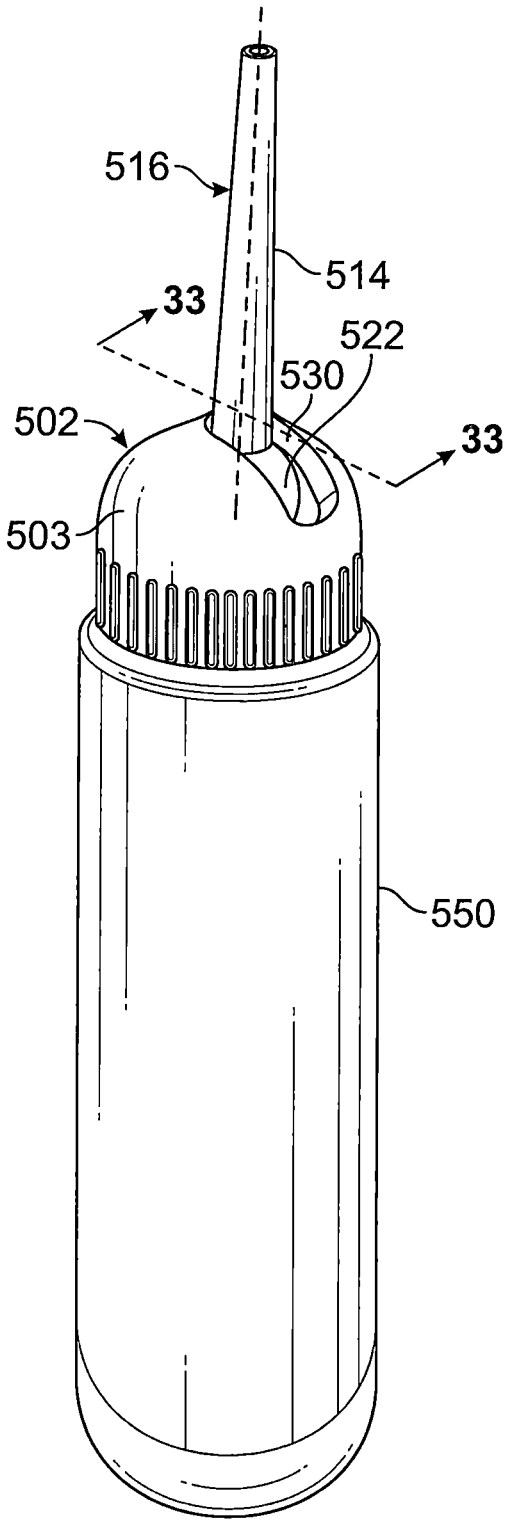
FIG. 32 is an isometric view of the cap and squeeze bottle shown in FIG. 31, where the cap is in an open position.
Figure 33:
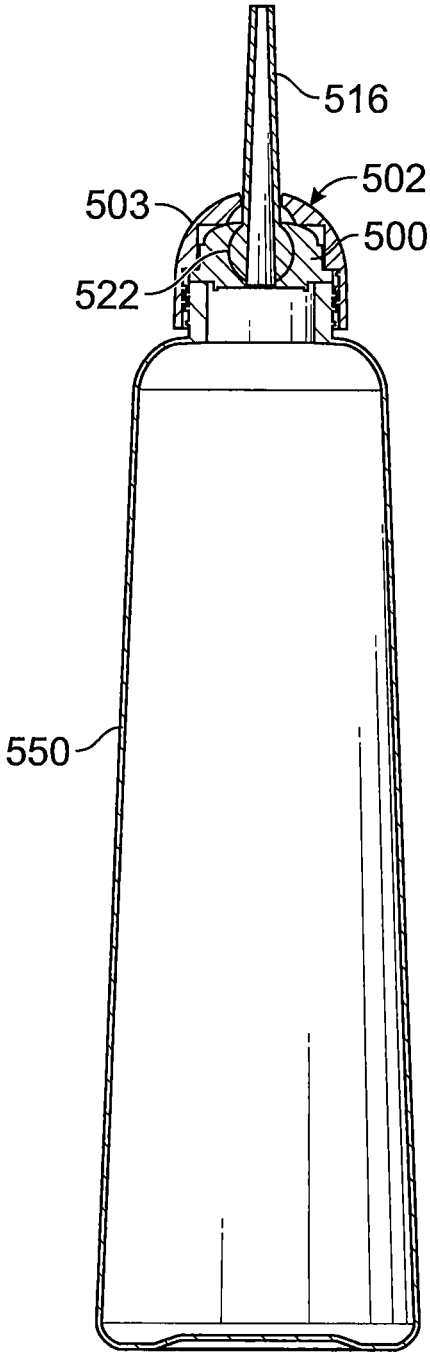
FIG. 33 is a cross-section view taken along line 33-33 of FIG. 32.
Figure 34:
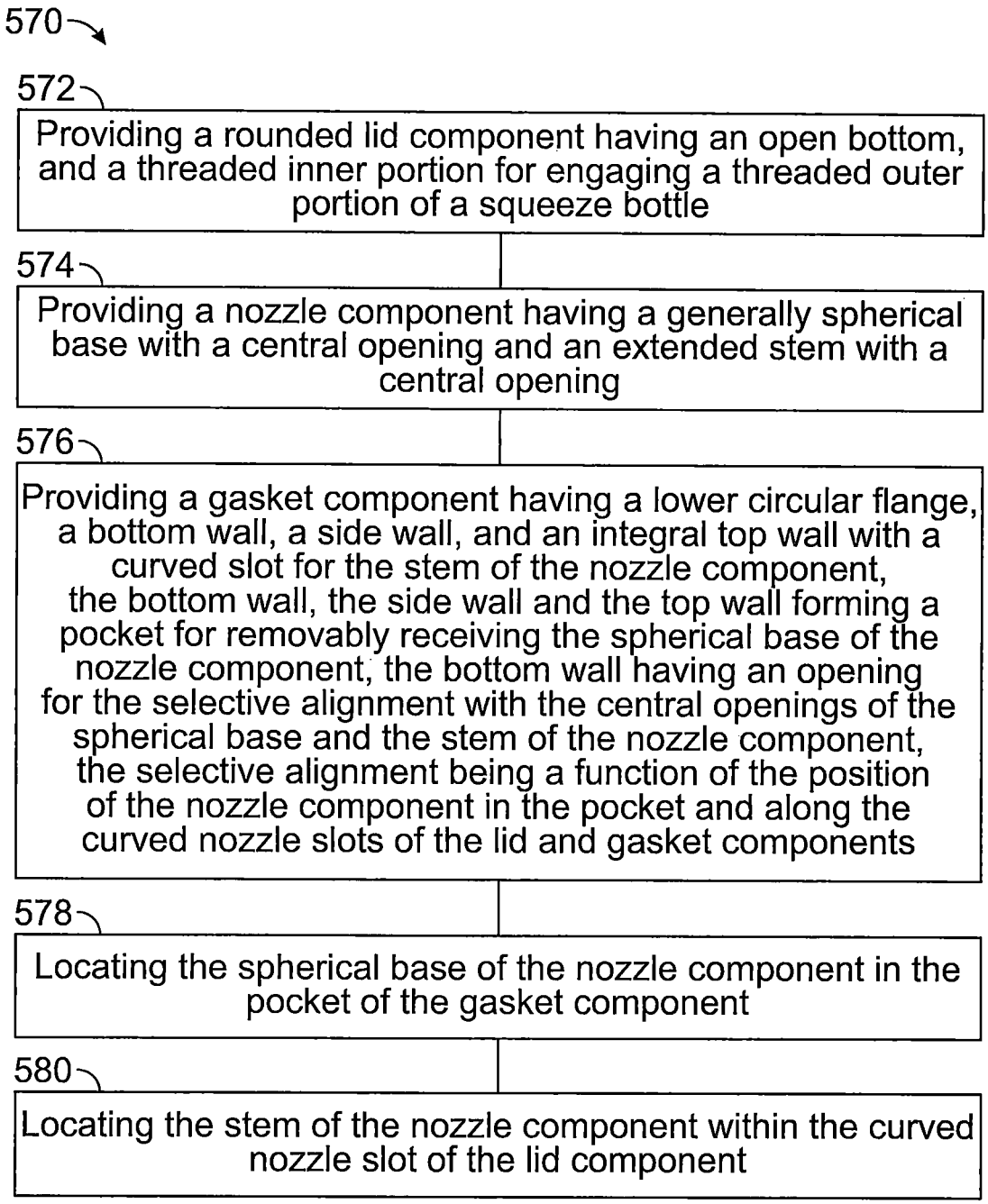
FIG. 34 is a flow diagram of a method for assembling a cap apparatus for the squeeze bottle.
Figure 35:
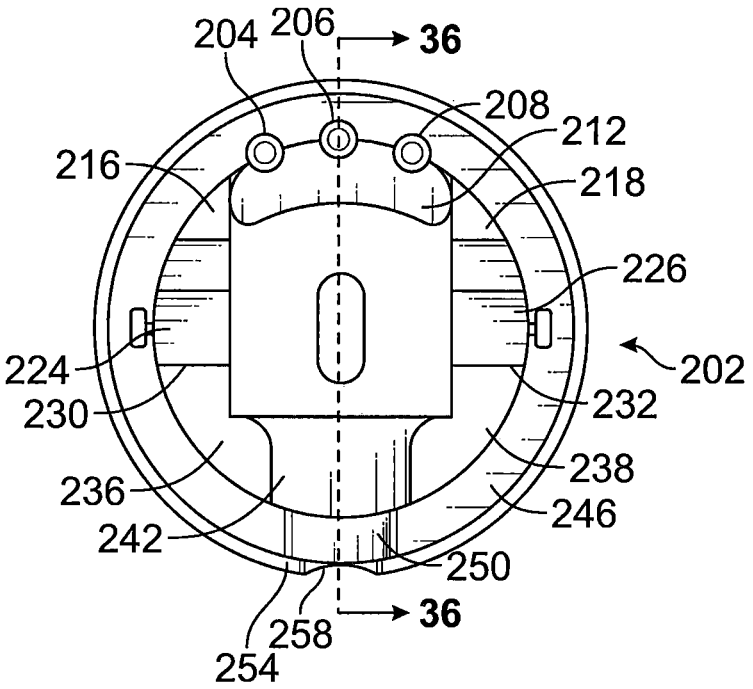
FIG. 35 (Prior Art)
FIG. 35 is a top plan view of a complicated prior art gasket.
Figure 36:
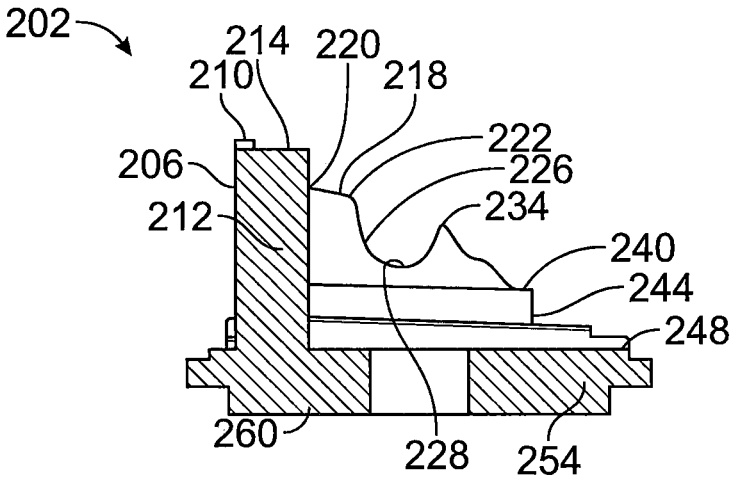
FIG. 36 (Prior Art)
FIG. 36 is a cross-sectional view taken along line 36-36 in FIG. 35.

Another gasket component embodiment 500 is illustrated in FIGS. 22-28, for use in another cap embodiment 502, FIGS. 31-33. The cap embodiment 502 includes the gasket component 500, a lid component 503 and a nozzle component 516. The gasket component 500 includes a lower circular flange portion 504 a bottom wall 506, a side wall 508, and an integral top wall 510 with a curved slot 512 for the stem 514, FIGS. 31 and 32, of the nozzle component 516, where the bottom wall 506, the side wall 508 and the top wall 510 forms a pocket 520, FIG. 28, for removably receiving a spherical base 522 of the nozzle component 516. The bottom wall 506 includes an opening 524 for selective alignment with the central openings like the central openings 62, 66 FIGS. 4 and 5 of the spherical base 522 and the stem 514 of the nozzle component 516, the selective alignment being a function of the position of the nozzle component in the pocket 520 and along a curved nozzle slot 530 of the lid component and the curved slot 512 of the gasket component.

Figure 10:
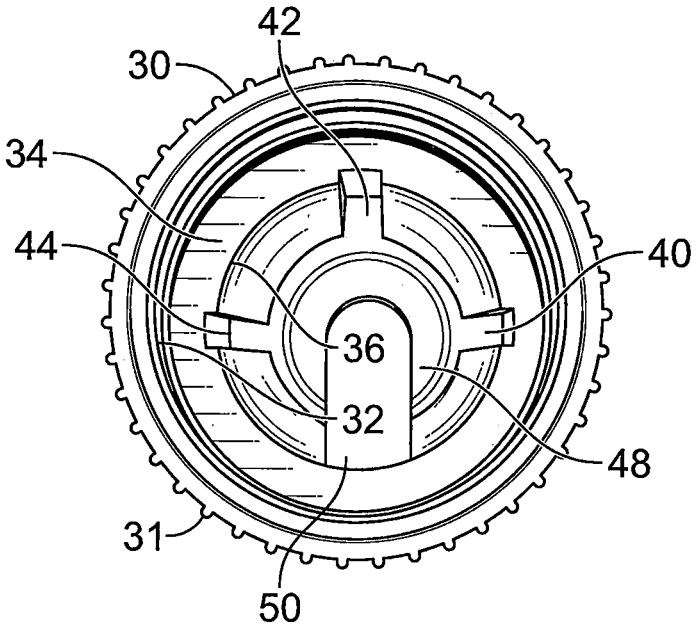
FIG. 10 is a bottom plan view of the lid component shown in FIGS. 6-9.
Figure 11:
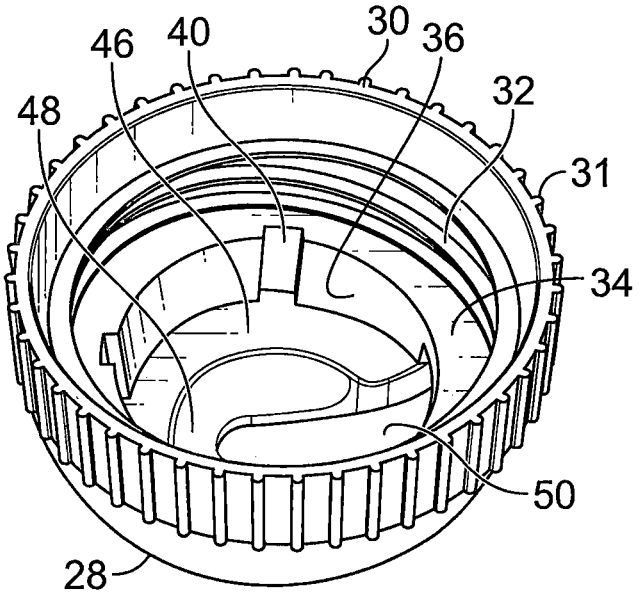
FIG. 11 is an isometric view of the bottom of the lid component shown in FIGS. 6-10.
Figure 12:
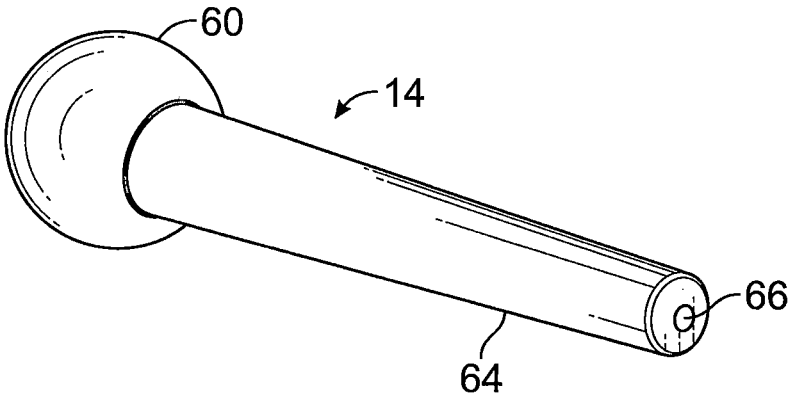
FIG. 12 is an enlarged isometric view of a nozzle component of the cap apparatus shown in FIGS. 1-3.

The sidewall 508 includes multiple ribs, such as the ribs 540, 542, 544, each rib for being received by a corresponding groove, such as the grooves 40, 42, 44, FIG. 10, in the lid component 20. Beneath the flange portion 504 and bordering the bottom wall 506 is a skirt wall 546. Defining the curved slot 512 is a border edge 548.

Figure 29:
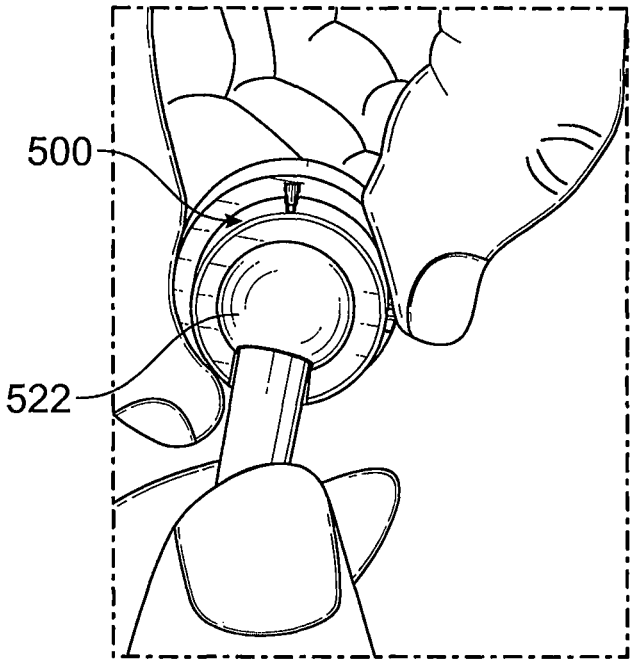
FIG. 29 is an isometric view of the gasket component and a nozzle component where a user is inserting the nozzle component into a pocket in the gasket component by applying pressure to a spherical base of the nozzle component to cause the top wall of the gasket component to deform.
Figure 30:
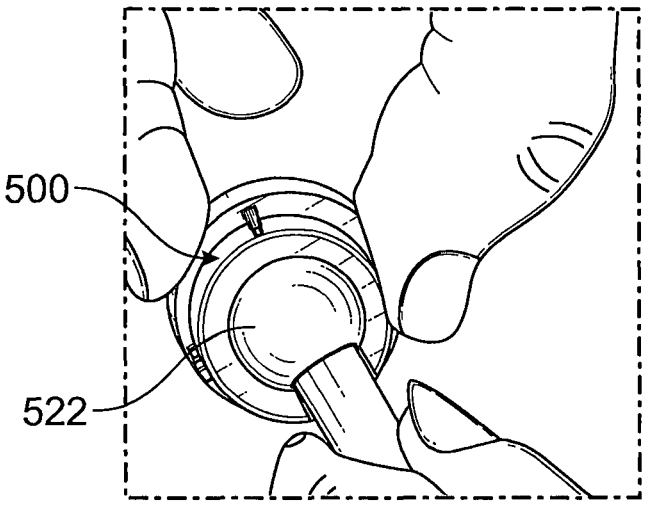
FIG. 30 is an isometric view of the gasket component and the nozzle component where the user is removing the nozzle component from the gasket component by pulling on a stem of the nozzle component causing the top wall of the gasket component to deform.

The gasket component 500 is formed of silicon, and the top wall dimensions are such that the top wall 510 is resilient, flexible, soft and deformable. This deformable top wall allows the relatively rigid spherical base 522 of the nozzle component 516 to be inserted into the pocket 520 of the gasket component. The deformable top wall 510 also facilitates the removal of the spherical base 522 of the nozzle component from the pocket by the user, the insertion and removal of the nozzle component being shown by FIGS. 29 and 30, for cleaning the cap, for example. In FIG. 29, the border edge 548 of the slot 512 of the gasket component 500 is shown deformed by the user as the spherical base 522 of the nozzle component 516 is inserted into the pocket 520 during assembly or after cleaning, for example, and in FIG. 30, the border edge 548 of the slot 512 is again shown deformed as the user is removing the spherical base 522 of the nozzle component 516 from the pocket 520 of the gasket component 500. The nozzle component is inserted into the pocket of the gasket component when the user applies pressure to the spherical base and when the nozzle component is removed from the gasket component the user pulls on the stem of the nozzle component. Once inserted, the spherical base fits snugly in the pocket and baring an external force will not move, thus, the spherical base remains secured in the pocket, but the user is still able to move the nozzle component between open and closed position when desired, and, as mentioned above, the user is able to separate the nozzle component from the gasket component.

The width of the gasket component slot 512 is smaller than the diameter of the spherical base 522 of the nozzle component, but because the top wall of the gasket component is deformable the spherical base is able to be inserted and removed at will.

The outer diameter of the lower flange 504 of the gasket component 500 may be about 30.6 mm, and the height of the gasket component may be about 13.9 mm. The sidewall 508 may have height of about 5.9 mm and a diameter of about 24.4 mm. The width of the slot 512 may be about 8.2 mm, and the thickness of the top wall 510 may be about 0.76 mm. The height of the top wall 510 may be about 3.7 mm whereas the diameter of the pocket 514 may be about 14 mm. The diameter of the skirt wall 546 may be about 19.6 mm, the depth of the skirt wall about 1.6 mm and the opening 524 in the bottom wall may be about 6 mm. In comparison to the width of the slot 512 of 8.2 mm, the maximum diameter of the spherical base of the nozzle component may be about 14 mm.

The gasket component 500 may be included in the cap 502, FIGS. 31 and 32, that appears identical to the cap 12, FIGS. 1 and 2. The cap 502 may include the lid component 532 and the nozzle component 516 which may be identical to the lid component 20 and the nozzle component 14, respectively, and may fit on a squeeze bottle 550 that is identical to the squeeze bottle 10.

Operation of the cap 502 may be identical to the operation of the cap 12 where when the nozzle component 516 is in a lowered position (see FIG. 31), the stem of the nozzle component is generally perpendicular to the longitudinal axis of the squeeze bottle 550, the squeeze bottle is closed. When the stem of the nozzle component is in a raised position (see FIGS. 32 and 33), the stem is generally parallel to the longitudinal axis of the squeeze bottle, and the squeeze bottle is open so that contents in the squeeze bottle may be dispensed.

The invention includes a method 570 for assembling a cap apparatus for a squeeze bottle including the steps of providing a rounded lid component having an open bottom, and a threaded inner portion for engaging a threaded outer portion of a squeeze bottle 572, providing a nozzle component having a generally spherical base with a central opening and an extended stem with a central opening 574, providing a gasket component having a lower circular flange, a bottom wall, a side wall, and an integral top wall with a curved slot for the conical stem of the nozzle component, the bottom wall, the side wall and the top wall forming a pocket for removably receiving the spherical base of the nozzle component, the bottom wall having an opening for selective alignment with the central openings of the spherical base and the stem of the nozzle component, the selective alignment being a function of the position of the nozzle component in the pocket and along the curved nozzle slots of the lid and gasket components 576, locating the spherical base of the nozzle component in the pocket of the gasket component 578 and locating the stem of the nozzle component within the curved nozzle slot of the lid component 580.

In comparison to existing caps, a prior-art cap shown in FIGS. 35-38, all of the parts have overly complicated structure that makes them more difficult and expensive to make and assemble, and seem to result in a poorer performance. For example, the prior art gasket 202, FIGS. 35 and 36, has three pillars 204, 206 208 that extends to a first level 210, a partial wall 212 that extends to a second level 214, two shoulders 216, 218 starting at a third level 220 and descending to a fourth level 222, two oppositely disposed curved surfaces 224, 226 dipping to a fifth level 228, both curved surfaces ending at peaks 230, 232 at a sixth level 234, a second set of descending surfaces 236, 238 ending at a seventh level 240, a nozzle seat 242 at an eighth level 244, a top ring base 246 at a ninth level 248 with a recess 250 at a tenth level 252, a lower base 254 at an eleventh level 256 having an indentation 258, and a bottom base 260.

Figure 37:
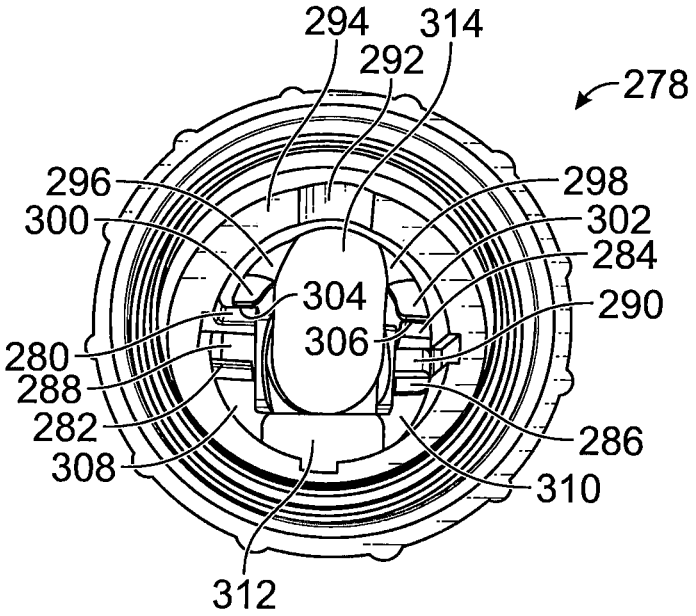
FIG. 37 (Prior Art)
FIG. 37 is a bottom plan view of a complicated prior art lid.
Figure 38:
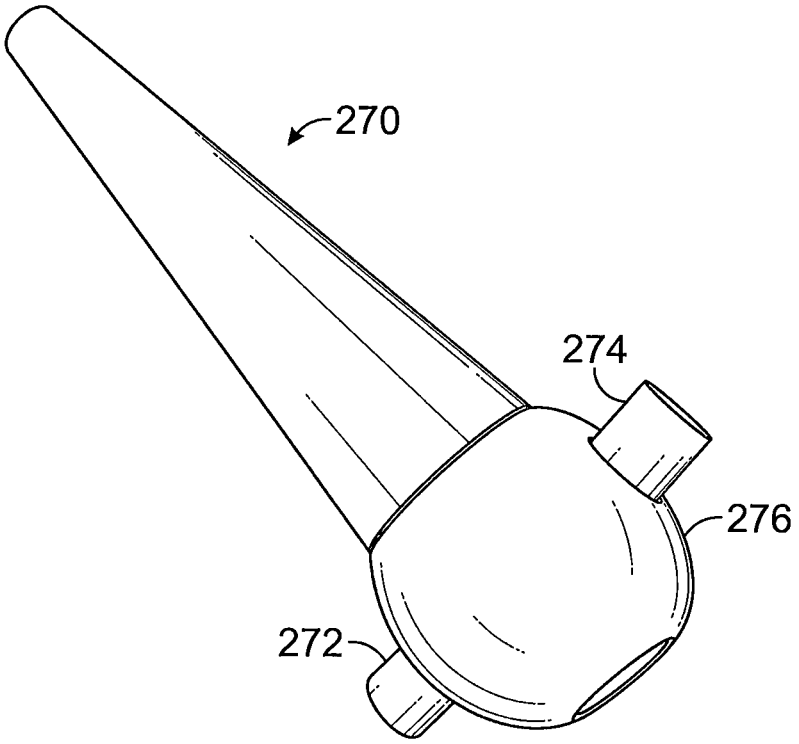
FIG. 38 (Prior Art)
FIG. 38 is an isometric view of a complicated prior art nozzle.

A prior art nozzle 270, FIG. 38, includes two lateral shafts 272, 274 extending from a base 276 that also requires the extra steps of aligning with a prior art lid 278, FIG. 37, and the prior art gasket 202 when the prior art cap is reassembled. The prior art cap is formed of rubber, which is inferior to silicon and has been found to leaks in use.

The prior art lid 278, FIG. 37, also has numerous levels in order to accommodate the complicated prior art gasket 202. The prior art lid and gasket compliment each other whereby the lid 278 has many levels like the gasket, which results in the lid having a very complex structure. For example, the prior art lid 278 includes two pairs of horizontal ribs 280, 282, 284, 286 for seating the lateral shafts 272, 274 of the nozzle in a pair of horizontal 'valleys' 288, 290, a recess 292 in a flange 294, a first pair of generally horizontal surfaces 296, 298 contiguous, respectively, with slanted surfaces 300, 302, a pair of vertical walls 304, 306, a pair of curved walls 308, 310 and a curved back wall 312 near the top of a lid slot 314.

Operation of the inventive cap 12 relative to the bottle 10 is very simple. The cap 12 is easily removed from the bottle 10 by twisting the cap in a counterclockwise direction when the user is ready to fill the bottle with a flowable content such as ketchup, hair dye, soap and the like. After washing, the nozzle and gasket components are inserted into the lid component, and the lid component is twisted clockwise.

It is noted that throughout this detailed description, words such as "forward," "rearward," "upper," "lower," "front," "rear," "top" and "bottom," as well as similar positional terms, refer to portions or elements of the cap as they are viewed in the drawings, or in relationship to the positions of the apparatus as it will typically be deployed and moved during use, or to movements of elements based on the configurations illustrated.

From the foregoing, it can be seen that there has been provided a detailed description of features for an improved squeeze bottle cap apparatus as well as a disclosure of a method for making the cap apparatus. While particular embodiments of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A cap for a squeeze bottle comprising:

a lid component having a rounded shape, an open bottom, an inner portion for engaging an outer portion of a bottle, the inner portion of the lid having a first diameter, the lid component also having a lower flange located above the inner portion, an integral sidewall having multiple grooves extending away from the lower flange above the inner portion, an integral upper flange, an integral curved nozzle seat located above the grooves and the upper flange, and a curved nozzle slot;

a nozzle component having a spherical base with a central opening and a conical stem with a central opening extending from the spherical base, a centerline of the central openings of the base and the conical stem defining a longitudinal axis of the nozzle component, the spherical base for being received by the nozzle seat of the lid component, and the conical stem for rotating within the curved nozzle slot; and a gasket component having a lower circular flange, a bottom wall, a side wall, and an integral top wall, the side wall and the top wall forming a pocket for removably receiving the spherical base of the nozzle component, the bottom wall having an opening for selective alignment with the central openings of the spherical base and the conical stem of the nozzle component, the selective alignment being a function of an angle of the nozzle component in the pocket and alignment with the curved nozzle slot of the lid component.

2. The cap claimed in claim 1, wherein the top wall of the gasket component is deformable.

3. The cap claimed in claim 1, wherein a diameter of a border edge of the pocket is smaller than the diameter of the spherical base of the nozzle and wherein the border edge and the spherical base are configured such that inserting the spherical base of the nozzle component into the pocket of the gasket component requires application of pressure to force the spherical based through the border edge.

4. The cap claimed in claim 3, wherein the spherical base of the nozzle is removable from the pocket of the gasket component by application of a pulling force on the conical stem of the nozzle component.

5. The cap claimed in claim 1, wherein a beveled surface of the lid component extends around the lid component except for spaces occupied by the curved nozzle slot and the grooves.

6. The cap claimed in claim 1, wherein the gasket component includes a lower circular wall.

7. The cap claimed in claim 6, wherein the nozzle seat of the gasket component is above the lower circular wall.

8. The cap claimed in claim 1, wherein:

the top wall of the gasket component is at a constant height except at a recess dimensioned to support the conical stem of the nozzle component; and the upper flange of the lid component extends around the lid component except at the curved nozzle slot.

9. The cap claimed in claim 1, wherein:

a beveled surface of the lid component extends around the lid component except for spaces occupied by the curved nozzle slot and the grooves; and the seat for the base of the nozzle component in the gasket component is shaped as a partial sphere.

10. The cap claimed in claim 1, wherein:

the top wall of the gasket component is at a constant height level except at a recess dimensioned to support the conical stem of the nozzle component;

the lower flange of the lid component extends around the lid component except at the curved nozzle slot; and a beveled surface of the lid component extends around the lid component except for spaces occupied by the curved nozzle slot and the grooves.

11. The cap claimed in claim 1, wherein:

the top wall of the gasket component is at a constant height except at a recess dimensioned to support the conical stem of the nozzle component;

the lower flange of the lid component extends around the lid component except at the curved nozzle slot; and the seat for the base of the nozzle component in the gasket component is shaped as a partial sphere.

12. The cap claimed in claim 1, wherein:

the top wall of the gasket component is at a constant height except at a recess dimensioned to support the conical stem of the nozzle component;

the lower flange of the lid component extends around the lid component except at the curved nozzle slot; and the gasket component includes a lower circular wall.

13. The cap claimed in claim 1, wherein the top wall extending around to a recess for seating the conical stem of the nozzle component, the nozzle seat having a central opening, the central opening in the nozzle seat for selectively aligning with the central openings of the nozzle base and the conical stem of the nozzle component to enable flowable content of the bottle to exit the bottle wherein the conical stem of the nozzle component is able to rotate about ninety degrees between a closed position where the bottle is closed and the conical stem of the nozzle component is perpendicular to a longitudinal axis of the bottle and an open position where the bottle is open and the conical stem of the nozzle component is parallel to the longitudinal axis of the bottle.

14. The cap claimed in claim 1, wherein:

the spherical base of the nozzle component is insertable into the pocket of the gasket component by application of pressure on the base; and the spherical base of the nozzle is removable from the pocket of the gasket component by application of a pulling force on the conical stem of the nozzle.

15. A method for assembling a cap apparatus for a squeeze bottle comprising the steps of:

providing a rounded lid component having an open bottom, an inner portion for engaging an outer portion of a squeeze bottle, the inner portion of the lid having a first diameter, an integral lower flange located above the inner portion, an integral a sidewall having multiple grooves extending away from the lower flange above the inner portion, an integral beveled surface located above the sidewall, an integral upper flange, an integral curved nozzle seat located above the grooves and the upper flange, and a curved nozzle slot;

providing a nozzle component having a spherical base with a central opening and a conical stem with a central opening extending from the spherical base, a centerline of the central openings of the spherical base and the conical stem defining a longitudinal axis of the nozzle component;

providing a gasket component having a lower circular flange, a bottom wall, a side wall, and an integral top wall, the side wall and the top wall forming a pocket for removably receiving the spherical base of the nozzle component, the bottom wall having an opening for selective alignment with the central openings of the spherical base and the conical stem of the nozzle component, the selective alignment being a function of an angle of the nozzle component in the pocket and alignment with the curved nozzle slot of the lid component; and locating the spherical base of the nozzle component in the pocket of the gasket component.

16. The method claimed in claim 15, rotating the conical stem of the nozzle component about ninety degrees between an open position where the longitudinal axes of the nozzle component and of the bottle are generally parallel to enable flowable content in the bottle to exit the bottle through the nozzle component and a closed position where the central opening of the conical stem of the nozzle component is perpendicular to the longitudinal axis of the bottle such that the flowable content cannot exit the bottle through the nozzle component.

17. The method claimed in claim 16, further comprising locating the opening in the nozzle seat of the gasket component to align with the central openings of the spherical base and the conical stem of the nozzle component to enable flowable content in the bottle to exit the bottle when the longitudinal axis of the nozzle component is parallel with a longitudinal axis of the bottle.

18. The method claimed in claim 15, wherein the top wall of the gasket component is deformable and further comprising applying pressure to the spherical base of the nozzle component to insert the spherical base into the pocket of the gasket component.

19. The method claimed in claim 18, further comprising locating the conical stem of the nozzle component within the curved nozzle slot of the lid component to put the cap apparatus in a closed position such that flowable content cannot exit the bottle through the nozzle component.

* * * * *